US009241557B2

(12) United States Patent
Abramowitz et al.

(10) Patent No.: US 9,241,557 B2
(45) Date of Patent: Jan. 26, 2016

(54) SNOW SPORT BAG

(75) Inventors: David Eric Abramowitz, Westwood, MA (US); Austin Scott Brown, Hanover, PA (US); Brent Hampton Harris, Petaluma, CA (US)

(73) Assignee: Kulkea, LLC, Westwood, MA (US)

( * ) Notice: Subject to any disclaimer, the term of this patent is extended or adjusted under 35 U.S.C. 154(b) by 239 days.

(21) Appl. No.: 13/557,713

(22) Filed: Jul. 25, 2012

(65) Prior Publication Data

US 2013/0026204 A1 Jan. 31, 2013

Related U.S. Application Data

(60) Provisional application No. 61/511,642, filed on Jul. 26, 2011.

(51) Int. Cl.

| | |
|---|---|
| ***A45F 3/04*** | (2006.01) |
| ***A45C 13/03*** | (2006.01) |
| ***A43B 5/04*** | (2006.01) |

(52) U.S. Cl.

CPC ..... *A45F 3/04* (2013.01); *A43B 5/0425* (2013.01); *A45C 13/03* (2013.01)

(58) Field of Classification Search

CPC ..... A45F 3/04; A43B 5/0425; A45C 13/03
USPC ..... 224/917, 576, 600–659
See application file for complete search history.

(56) References Cited

U.S. PATENT DOCUMENTS

| | | | | |
|---|---|---|---|---|
| 5,509,589 | A * | 4/1996 | Kliot | 224/637 |
| D408,993 | S * | 5/1999 | Kliot | D3/283 |
| 2003/0121945 | A1* | 7/2003 | Lemanski, II | 224/579 |
| 2003/0205601 | A1* | 11/2003 | Kilduff | 224/627 |
| 2006/0118376 | A1* | 6/2006 | Godshaw et al. | 190/107 |
| 2007/0164070 | A1* | 7/2007 | Bevier | 224/643 |
| 2007/0272570 | A1* | 11/2007 | Brooks | 206/315.9 |
| 2010/0108730 | A1* | 5/2010 | Sabbah | 224/651 |

FOREIGN PATENT DOCUMENTS

| | | | | |
|---|---|---|---|---|
| EP | 611532 | A1 * | 8/1994 | A45F 3/08 |

* cited by examiner

*Primary Examiner* — Justin Larson
*Assistant Examiner* — Phillip Schmidt
(74) *Attorney, Agent, or Firm* — Chapin IP Law, LLC

(57) ABSTRACT

Articles disclosed herein include a bag that provides various improvement mechanisms over existing backpacks. The bag provides a transport mechanism for carrying various items, such as ski boots or snowboard boots, gloves, helmets, hats, goggles, and other snow equipment common to skiing, snowboarding or other outdoor snow sports. The bag can include a pair of side compartments that carry boots in an approximately triangular compartment. Each side compartment includes a boot void compartment positioned above where a boot toe would be, and in front of a boot shin portion, thereby maximizing storage space an increasing organization convenience. Other features include quick-release shoulder straps for quick access to the bag member while still being supported on a shoulder. The bag can include a front compartment and central compartment, with an interior of the front compartment easily viewable.

23 Claims, 4 Drawing Sheets

SNOW SPORT BAG

CROSS REFERENCE TO RELATED APPLICATIONS

The present application claims the benefit of U.S. Provisional Patent Application No. 61/511,642, filed on Jul. 26, 2011, entitled "Snow Sport Bag," which is incorporated herein by reference in its entirety.

BACKGROUND

The present disclosure relates to backpacks, bags, packs, and other devices and articles for carrying items. The present disclosure also relates to bags for carrying heavy or bulky items such as boots, snowboards, skis, and associated sporting equipment.

SUMMARY

Embodiments disclosed herein include a bag to store and provide easy transport of various sporting equipment including boots, ski boots, helmets, goggles and other ski or snowboard gear. Such embodiments provide a quick, efficient, and compact system for carrying sporting gear.

One embodiment includes a backpack or bag for carrying various sports equipment. The backpack includes a bag member having a back surface for contacting a user's back, a front surface, two opposing sides, a bottom surface, at least one shoulder strap attached adjacent to the back surface, and an upper end. There is a central compartment defined by the bag member. The central compartment is located between the back surface and the front surface. A pair of side compartments is located at the opposing sides such that each opposing side includes a side compartment. Each side compartment has an approximately triangular side profile. Each side compartment defines an opening sufficient to receive a boot. Each side compartment is also sized sufficiently to contain a boot in a generally upright position such that a foot bed of the boot rests on the bottom surface of the bag member. Each side compartment defines a boot void compartment within the side compartment, the boot void compartment having a generally triangular profile, and is located adjacent to the front face of the bag member such that when a boot is contained within the side compartment each boot void compartment is positioned between the front surface of the bag member, a shin portion of the boot, and a toe portion of the boot.

In another embodiment, a shoulder strap of the backpack has a top end and a bottom end, the top end is attached to the bag member at a first point and the bottom end at a second point. The first point is located on the back surface adjacent to the upper end of the bag member, the second point is located at a lower portion of the bag member adjacent to the bottom surface, wherein the first shoulder strap includes a quick-release detachment mechanism adjacent to the second point of attachment. The quick-release detachment mechanism is configured to detach the bottom end of the first shoulder strap from the bag member.

In another embodiment, the bag member includes a front compartment. The front compartment is accessed via a front closable opening on the front surface that permits horizontal access into the front compartment. The front compartment is separated from the central compartment by a divider extending at least partially from the bottom surface to the upper end of the bag member.

As discussed above, embodiments herein are well suited for use in bags for carrying skiing equipment and snowboarding equipment. It should be noted, however, that embodiments herein are not limited to use in such applications and that the techniques discussed herein are well suited for other applications as well. For example, such techniques can be used for carrying fishing equipment, hockey skates skates, lacrosse equipment, landscaping tools, mechanical equipment, etc.

Additionally, although each of the different features, techniques, configurations, etc. herein may be discussed in different places of this disclosure, it is intended that each of the concepts can be executed independently of each other or in combination with each other. Accordingly, the present invention can be embodied and viewed in many different ways.

Note that this summary section herein does not specify every embodiment and/or incrementally novel aspect of the present disclosure or claimed invention. Instead, this summary only provides a preliminary discussion of different embodiments and corresponding points of novelty over conventional techniques. For additional details and/or possible perspectives of the invention and embodiments, the reader is directed to the Detailed Description section and corresponding figures of the present disclosure as further discussed below.

BRIEF DESCRIPTION OF THE DRAWINGS

The foregoing and other objects, features, and advantages of the invention will be apparent from the following more particular description of preferred embodiments herein as illustrated in the accompanying drawings in which like reference characters refer to the same parts throughout the different views. The drawings are not necessarily to scale, with emphasis instead being placed upon illustrating the embodiments, principles and concepts.

DESCRIPTION

Articles disclosed herein include a bag that provides various improvement mechanisms over existing backpacks. While there are many different types of items that embodiments of the bag can carry, for convenience in describing embodiments of the bag, the following description and figures primarily describe a snow sport bag or sport bag that can carry a pair of boots. The snow sport bag provides a transport mechanism for carrying various items, such as ski boots or snowboard boots, gloves, helmets, hats, goggles, and other snow equipment common to skiing, snowboarding or other outdoor snow sports.

Figure 1:
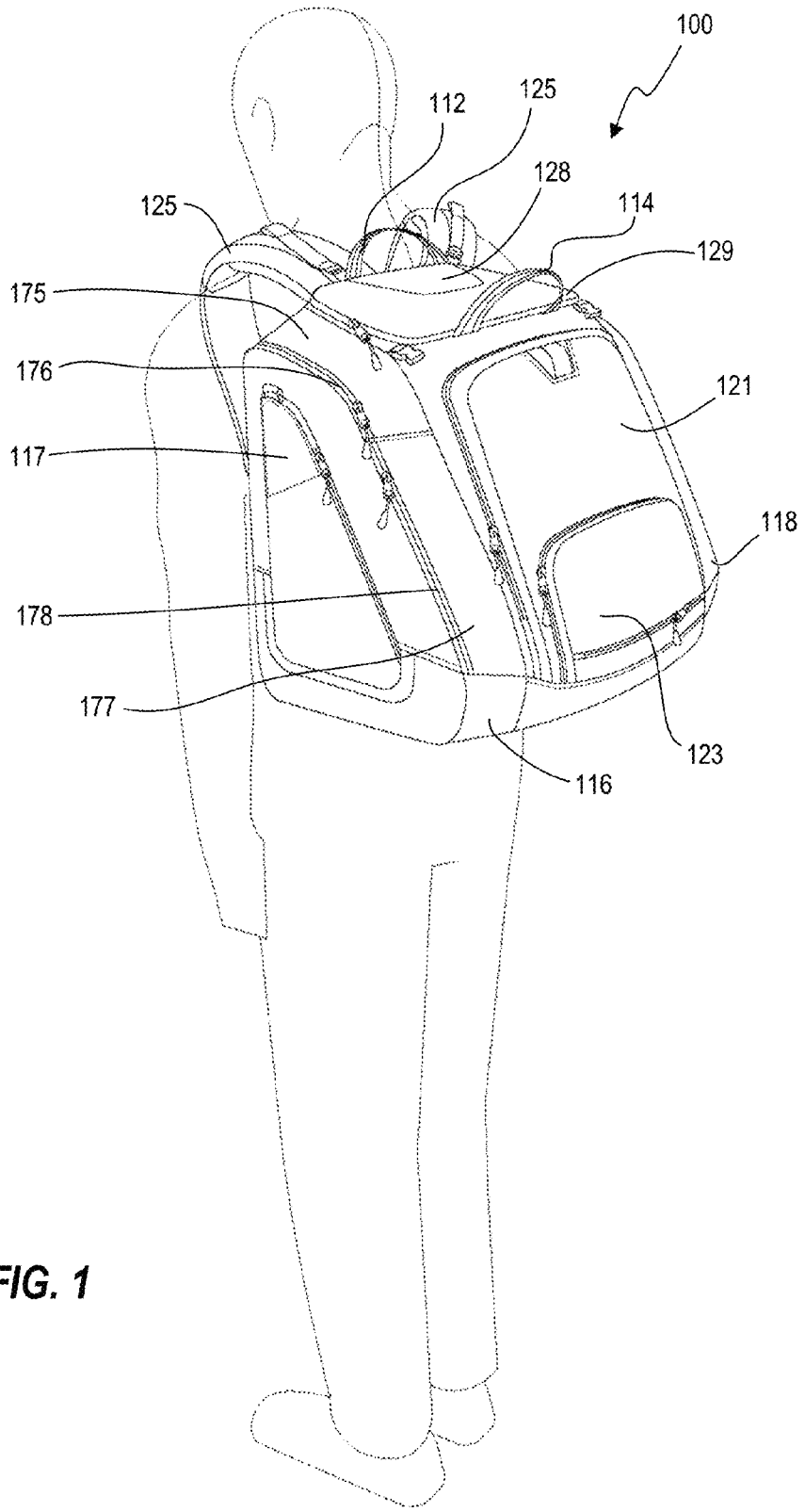
FIG. 1 is a perspective view of a backpack according to embodiments disclosed herein.

FIG. 1 is a perspective view of bag 100. Bag 100 in this illustration is generally configured as a backpack that includes several storage compartments. Handle 112 or handle 114 can be used to lift and hold the bag 100. Side compartments 116 and 118 can be used for containing ski or snowboard boots, footwear, or other equipment. Side compartments 116 and 118 can include a vent flap 117 that when opened helps damp boots, apparel and equipment to dry faster when still contained within the bag and when closed helps keep rain and snow out of the bag. In this example, vent flap 117 is shown in a closed position and fastened by a hook and loop mechanism. Front compartment 121 and front compartment 123 can also be used for storing apparel, equipment and various items. Front compartments can be attached to, or a part of, central compartment 129.

Central compartment 129 is accessible via top cover 128. Top cover 128 can use any conventional fastening mechanism for covering a top opening to the central compartment 129. Shoulder straps 125 enable the bag 100 to be worn or carried as a backpack or shoulder bag.

The bag 100 can include boot void compartment 177 having boot void compartment opening 178. The bag 100 can also include boot compartment 175 having boot compartment opening 176. Boot void compartment pocket 177 as well as boot compartment 175 can be a portion of, or considered together as, side compartment 116. That is, side compartment 116 can comprise two or more individual compartments including both the boot compartment 175 and the boot void compartment 177. This side compartment and sub-compartments will be described in more detail in subsequent figures.

With side compartments 116 and 118 on either side of the front and central compartments, boots can be stored in the side compartments, while other items can be stored within the center and front compartments. In other embodiments, the bag can be designed as a conventional backpack that has added side boot compartments including a compartment that takes advantage of boot compartment void space.

Figure 2:
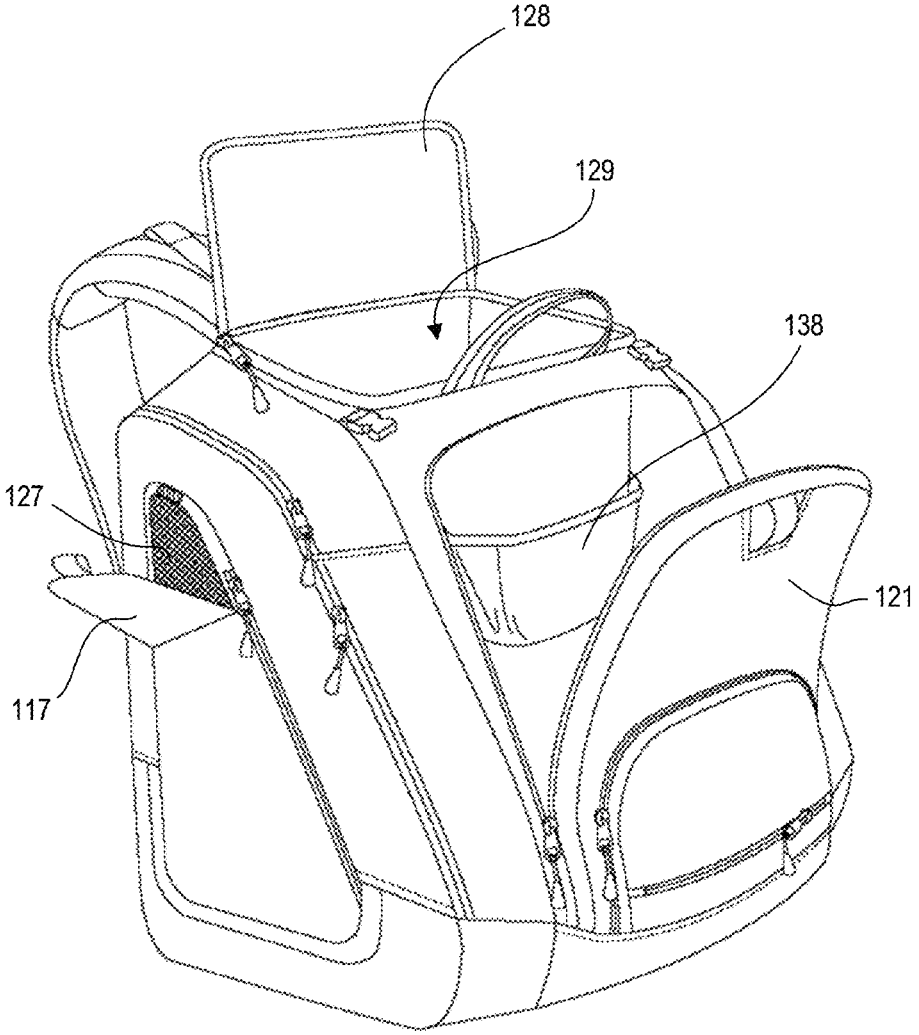
FIG. 2 is a perspective view of a backpack showing various openings and a vent closure according to embodiments disclosed herein.

FIG. 2 is a perspective view of bag 100 showing some open compartments. Front compartment 121 is shown in an open position revealing an interior goggle or sunglasses pocket 138. Central compartment cover 128 is depicted in an open position revealing accesses to central compartment 129. In some embodiments, central compartment can be sized relatively larger than front and side compartments, such as to function as a primary storage compartment.

Vent flap 117 is shown in an open position, revealing vent 127. Vent 127 can be an unobstructed opening, or can use grommets or a mesh material covering (as shown) that enables rapid air flow in and out of boot compartment 175. Each boot compartment can have such a vent or multiple vents. Boot compartments can also include grommets or drain holes (not shown) for snow and slush and water on the bottom of boots contained inside boot compartments to drain from the bag 100.

Figure 3:
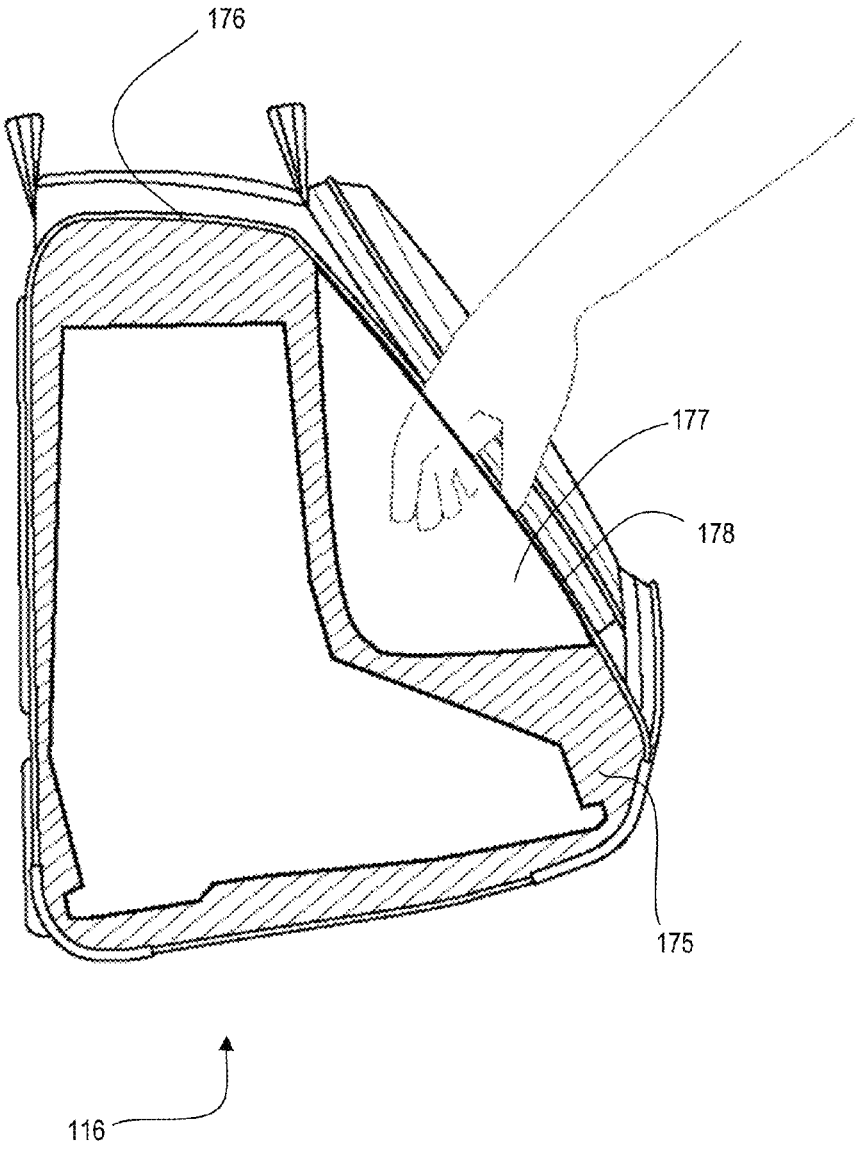
FIG. 3 is a side cross-sectional view of a backpack and a boot void compartment according to embodiments disclosed herein.

FIG. 3 is a cross-sectional view of side compartment 116. Note that side compartment 116 can have an overall shape sized to receive a ski boot (or snowboard boot), but that defines a shape having one side being angled from a top portion (of where a boot top front edge would be positioned in the boot compartment) to a toe portion (of where a boot toe would be positioned in the boot. Thus, instead of the side compartment being embodied as simply a square cross section, or even having a cross section that exactly follows the contours of a boot, the cross section has a generally straight and angled line in front of where a boot front would be positioned. In other words, the side compartments follow or match a cross section of the entire bag, such as the cross-section of the center and front compartments. Since the combination of the front and central compartment cross section is not boot-shaped, then the side boot compartment is likewise not boot-shaped. Because the side compartments follow the cross section of the bag in general, with a bag side cross section having an approximately square or trapezoidal shape, a boot positioned within a side compartment will not effectively use all space available for storing the boot. That is, there will be an unused portion of a compartment above a toe portion of a boot, and in front of a shin portion of a boot.

Techniques disclosed herein take advantage of this void space between this angled edge and the front of a positioned boot, by creating a boot void compartment 177. Boot void compartment 177 can be an ideal storage location for ski gloves or other sporting equipment. For example, such a compartment or pocket can provide quick access to items used regularly. The boot void compartment can be located in the side compartment so as to be adjacent to a shin portion of a ski boot positioned within boot compartment 175. The boot void compartment can be embodied as a mesh pocket, thereby allowing items in the boot void compartment to dry out along with a positioned boot when the vent flap 117 is open. In some embodiments, the boot void pocket can have a generally triangular cross section when the front of the bag is angled. In other embodiments, the cross section of bag 100 can be more rectangular. In such an embodiment, the boot void compartment 177 can have a more rectangular shape.

Figure 4:
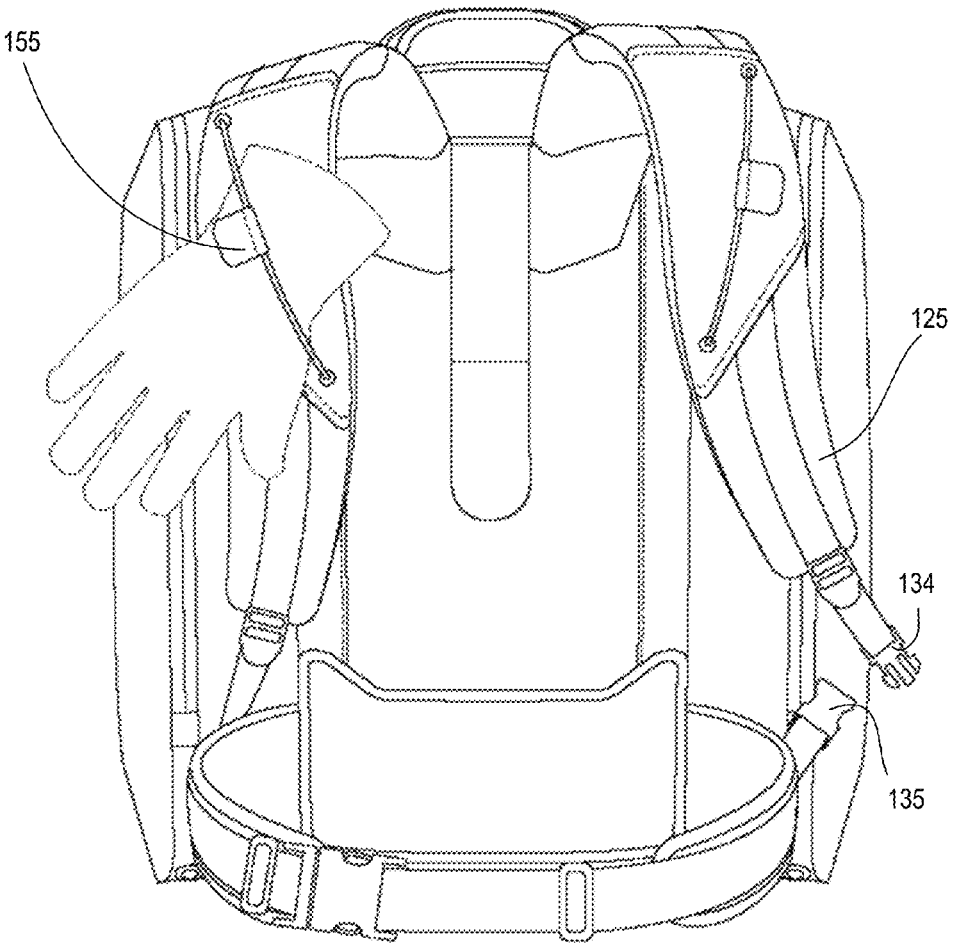
FIG. 4 is a back view of a backpack showing a detachable shoulder strap and shoulder strap article holder according to embodiments disclosed herein.

FIG. 4 shows a back view of the bag 100. That is, FIG. 4 shows a view of a portion of bag 100 designed to contact a carrier's back. Shoulder straps 125 can include cords or straps 155 for attaching items such as gloves, hats, mittens, and other items for quick storage and release, without having to remove the backpack. For example, a carrier of the bag 100 might need to remove gloves from the carrier's hands. The carrier can quickly stow the gloves via straps 155, for a particular task, and then quickly access gloves after completing the particular task. While FIG. 4 depicts a cord or strap for holding gloves, other mechanisms can be used such as clips, hook and loop fasteners, etc.

For the cord/strap embodiment, the strap can attach to a front portion of a shoulder strap at two different points, and be tensioned sufficiently to press a glove between the cord and the shoulder strap. The straps would not be tensioned to prevent removal by hand, but sufficiently tense to hold the weight of a glove or equivalent object by pressing that object against the front of the shoulder strap, but enabling quick removal by hand, such as by pulling a glove out of it position between the shoulder strap and the strap 155.

Bags can have a double or single shoulder strap system. In configurations of a double shoulder strap, each shoulder strap can include a detachable mechanism 134/135 or connector that detaches at a bottom connection to the bag. That is, there is a connection mechanism located near a waist portion of the bag for quickly detaching a particular shoulder strap. With such a releasable connection, a user wearing the bag with a shoulder strap positioned over each shoulder can release one of the lower shoulder strap connectors to quickly convert the bag into a single strap bag. With the new single strap configuration, a user can easily swing the bag to one side of the body, which can be useful for accessing storage compartments of the backpack or maneuvering through crowded areas.

Bags and backpacks as disclosed herein can include various embodiments and combinations of features.

One embodiment is a backpack for skiing equipment. The backpack has a bag member including a back surface designed for contacting a user's back, a front surface, two opposing sides, a bottom surface, and at least one shoulder strap attached adjacent to the back surface, and an upper end. When the backpack is positioned on a user's shoulder, the upper end would be near a user's head, while the bottom surface would face towards the ground. The backpack includes a central compartment defined by the bag member. The central compartment is positioned or located between the back surface and the front surface, and can also be located between the side surfaces. A pair of side compartments is located at the opposing sides such that each opposing side includes a side compartment. Side compartments can be integral with the bag member, or separately attached during manufacturing. Each side compartment has an approximately triangular side profile. For example, the profile can be approximately triangular while having rounded edges or corners such that some corners appear squared off, but, on a whole, the side compartment is still generally rectangular. Each side compartment defines an opening sufficient to receive a boot. Each side compartment can be sized sufficiently to contain a boot in a generally upright position such that a foot bed of the boot rests on the bottom surface of the bag member. In other words, with the backpack being carried on a given user, any given boot carried by the backpack, is in a generally upright orientation within a side compartment. Each side compartment defines a boot void compartment within the side compartment, the boot void compartment has a generally triangular profile and is located adjacent to the front face of the bag member such that when a boot is contained within the side compartment each boot void compartment is positioned between the front surface of the bag member, a shin portion of the boot, and a toe portion of the boot. In other words, boots are generally L-shaped. Having an approximately triangular bag profile for an L-shaped object means that a bag line extends from a toe portions to an upper heel portion of the boot. This yields empty space which, with techniques herein, is converted into a separate compartment for storing various articles, thereby efficiently using space.

In other embodiments, each boot void compartment can define an opening accessed from the front surface of the bag member, and/or from a side surface of the bag member. Each side compartment can define an opening, accessed from the upper end, sufficient to receive a boot. That is, a zippered, hook-and-loop, etc., opening can be sufficiently wide to receive a boot. Also, each side compartment can be sized and configured to hold a ski boot. Each side compartment can include a vent that can be opened and closed. For example, a flap can cover a grommet or mesh vent, and this flap can be pulled away from the side compartment and partially released via a zipper, tie, hook-and-loop fastener, or other fastening mechanism.

Optionally, the backpack can include an article strap positioned on the at least one shoulder strap. The article strap has a length shorter than a length of the shoulder strap. The article strap is tensioned sufficiently to hold an article of clothing between the article strap and the at least one shoulder strap. For example, an elastic strap on the shoulder strap can hold a glove, a hat, papers, or other articles for quick access.

The upper end of the backpack can define an upper opening to the central compartment. The upper opening can be sized to receive at least one pair of skis and accompanying bindings in a lengthwise direction. The bag member defines a bottom opening in the bottom surface. The defined bottom opening is sized to receive the at least one pair of skis in a lengthwise direction. Such a feature is described in more detail in U.S. Patent Application Publication Number 2011/0180575 entitled "Snow Sport Bag," and filed on Jan. 21, 2011, the specification of which is incorporated by reference in its entirety.

Optionally, the side compartments can be oriented at an angle relative to the back surface such that the bag member defines the central compartment as being of a generally isosceles triangular shape, that is, triangularly shaped along a longitudinal axis such as looking at the backpack from above with the upper end and bottom surface aligned.

In an alternative embodiment, the backpack comprises a bag member including a back surface for contacting a user's back, a front surface, two opposing sides, a bottom surface, a first shoulder strap, and an upper end. A central compartment, defined by the bag member, is located between the back surface and the front surface. A pair of side compartments is located at the opposing sides such that each opposing side includes a side compartment. Each side compartment has an approximately triangular side profile. Each side compartment defines an opening sufficient to receive a boot. Each side compartment is sized sufficiently to contain a boot in a generally upright position such that a foot bed of the boot rests on the bottom surface of the bag member. In this embodiment, the first shoulder strap has a top end and a bottom end. The top end is attached to the bag member at a first point and the bottom end at a second point. The first point is located on the back surface adjacent to the upper end of the bag member. For example, the shoulder strap can be attached directly to the back surface, attached at a seam between the back surface and the upper surface, or in that general area. The second point is located at a lower portion of the bag member adjacent to the bottom surface. For example, the second point can be directly on the back surface, at a seam between the back surface and the bottom surface, at a seam between the back surface and the side surface, or otherwise attached in that general area. The first shoulder strap includes a quick-release detachment mechanism adjacent to the second point of attachment. The quick-release detachment mechanism is configured to detach the bottom end of the first shoulder strap from the bag member. For example, a push clip can detach the shoulder strap from the bag, with the push clip easily accessed by a user when the backpack is on the user's back. With the shoulder strap release, the backpack can swing away from the user's shoulder while still being supported on the opposite shoulder.

In another embodiment, the bag includes a second shoulder strap, wherein the second shoulder strap has a top end and a bottom end, the top end is attached to the bag member at a first point and the bottom end at a second point. The first point is located on the back surface adjacent to the upper end of the bag member. The second point is located at a lower portion of the bag member adjacent to the bottom surface. Wherein the second shoulder strap includes a quick-release detachment mechanism adjacent to the second point of attachment. The quick-release detachment mechanism is configured to detach the bottom end of the second shoulder strap from the bag member. With both shoulder straps having a quick-release mechanism, a user can choose which direction to swing the backpack, that is, which shoulder strap will remain attached to support the backpack.

In another embodiment, the bag member defines a front compartment. The front compartment is accessed via a front closable opening on the front surface that permits horizontal access into the front compartment. The front compartment is separated from the central compartment by a divider extending at least partially from the bottom surface to the upper end of the bag member. This front closeable opening of the front compartment can close via a flap that, when opened, extends away from the bag member such that an interior of the front compartment is visible. With such visibility and access it is easy for a user to view and access contents of the front compartment. The interior of the front compartment can include an eyewear pouch sized to contain eyewear. In some embodiments, the top closeable opening is approximately a rectangular opening. This opening can be embodied as a flap.

As discussed above, embodiments herein are well suited for use in bags for carrying skiing equipment and snowboarding equipment. It should be noted, however, that embodiments herein are not limited to use in such applications and that the techniques discussed herein are well suited for other applications as well. For example, such techniques can be used for carrying gear for ice-skating, hockey, golfing, hiking, tennis, or landscaping tools, mechanical equipment, etc.

Additionally, although each of the different features, techniques, configurations, etc. herein may be discussed in different places of this disclosure, it is intended that each of the concepts can be executed independently of each other or in combination with each other. Accordingly, the present invention can be embodied and viewed in many different ways.

Those skilled in the art will also understand that there can be many variations made to the operations of the techniques explained above while still achieving the same objectives of the invention. Such variations are intended to be covered by the scope of this invention. As such, the foregoing description of embodiments of the invention are not intended to be limiting. Rather, any limitations to embodiments of the invention are presented in the following claims.

The invention claimed is:

1. A backpack for skiing equipment, the backpack comprising:

a bag member including a back surface for contacting a user's back, a front surface, two opposing sides, a bottom surface, at least one shoulder strap attached adjacent to the back surface, and an upper end;

a central compartment defined by the bag member, the central compartment located between the back surface and the front surface; and a pair of side compartments located at each of the opposing sides flanking the central compartment, each side compartment having an approximately triangular side profile defined by a respective opposed side surface, each side compartment defining an opening and a closure sufficient to receive a boot, and sized sufficiently to contain a boot in a generally upright position such that a foot bed of the boot rests on the bottom surface of the bag member, the front surface defined by a plane extending along the longest side of the triangular side profile between the opposed sides, a boot void compartment within each of the side compartments and having a closure vertically aligned with at least a portion of the closure of a respective side compartment, the boot void compartment having a generally triangular profile defined by the front surface and a smaller triangle sharing the longest side with the front surface, the boot void compartment defined by the front surface, a respective side surface and the smaller triangle, such that when a boot is contained in the generally upright position within the side compartment, each boot void compartment positioned between the front surface of the bag member, a shin portion of the boot, and a toe portion of the boot, the central compartment disposed between the side compartments and extending to the plane defining the front surface, the central compartment having a shape defined by the side compartments.

2. The backpack of claim 1, wherein each boot void compartment defines an opening accessed from the front surface of the bag member.

3. The backpack of claim 1, wherein each boot void compartment defines an opening accessed from a respective side of the bag member.

4. The backpack of claim 1, wherein each side compartment defines an opening, accessed from the upper end, sufficient to receive a boot.

5. The backpack of claim 4, wherein each side compartment is sized and configured to hold a ski boot.

6. The backpack of claim 1, wherein the at least one shoulder strap has a top end and a bottom end, the top end is attached to the bag member at a first point and the bottom end at a second point, the first point being located on the back surface adjacent to the upper end of the bag member, the second point being located at a lower portion of the bag member adjacent to the bottom surface and adapted to be positioned near the front waistline of a wearer of the backpack, wherein the first shoulder strap includes a quick-release detachment mechanism adjacent to the second point of attachment, the quick-release detachment mechanism configured to detach the bottom end of the at least one shoulder strap from the bag member.

7. The backpack of claim 1, wherein each side compartment includes a vent that is closeable.

8. The backpack of claim 1, further comprising an article strap positioned on the at least one shoulder strap, the article strap having a length shorter than a length of the shoulder strap, the article strap tensioned sufficiently to hold an article of clothing between the article strap and the at least one shoulder strap.

9. The backpack of claim 1, wherein the upper end defines an upper opening to the central compartment, the upper opening sized to receive at least one pair of skis and accompanying bindings in a lengthwise direction, the bag member defining a bottom opening in the bottom surface, the defined bottom opening sized to receive the at least one pair of skis in a lengthwise direction.

10. The backpack of claim 1, wherein the side compartments are oriented at an angle relative to the back surface such that the bag member defines the central compartment as being of a generally isosceles triangular shape.

11. The backpack of claim 1, wherein the central compartment and side compartments are adapted to be defined by a region above a toe portion of a ski boot and in front of a shin portion of the ski boot.

12. The backpack of claim 1, wherein the central compartment and side compartment are defined by a line extending from an upper heel portion to a toe portion of a ski boot disposed in the side compartment to form the boot void portion.

13. The backpack of claim 12, wherein the boot void compartment occupies a volume in front of the feet between the boot and the defined line, and the central compartment is between the side compartments and bounded by the defined line.

14. The backpack of claim 1 further comprising a self-contained helmet sling extending from the front of the bag, the self-contained helmet sling adapted for storage in a dedicated pouch when not deployed.

15. The backpack of claim 1 further comprising a separation subdividing a front compartment from the central compartment, the front compartment accessible from the front of the backpack and the central compartment accessible from the top of the backpack.

16. A backpack for skiing equipment, the backpack comprising:

a bag member including a back surface for contacting a user's back, a front surface, two opposing sides, a bottom surface, a first shoulder strap, and an upper end;

a central compartment defined by the bag member, the central compartment located between the back surface and the front surface;

a pair of side compartments located at each of the opposing sides flanking the central compartment, each side compartment having an approximately triangular side profile defined by a respective opposed side surface, each side compartment defining an opening and a closure sufficient to receive a boot, each side compartment sized sufficiently to contain a boot in a generally upright position such that a foot bed of the boot rests on the bottom surface of the bag member, the front surface defined by a plane extending along the longest side of the triangular side profile between the opposed sides;

a boot void compartment within each of the side compartments and having a closure vertically aligned with at least a portion of the closure of a respective side compartment, the boot void compartment having a generally triangular profile defined by the front surface and a smaller triangle sharing the longest side with the front surface, the boot void compartment defined by the front surface, a respective side surface and the smaller triangle such that when a boot is contained in the generally upright position within the side compartment, each boot void compartment is positioned adjacent the front surface of the bag member; and wherein the first shoulder strap has a top end and a bottom end, the top end is attached to the bag member at a first point and the bottom end at a second point, the first point being located on the back surface adjacent to the upper end of the bag member, the second point being located at a lower portion of the bag member adjacent to the bottom surface, wherein the first shoulder strap includes a quick-release detachment mechanism adjacent to the second point of attachment, the quick-release detachment mechanism configured to detach the bottom end of the first shoulder strap from the bag member.

17. The backpack of claim 16, further comprising:

a second shoulder strap, wherein the second shoulder strap has a top end and a bottom end, the top end is attached to the bag member at a first point and the bottom end at a second point, the first point being located on the back surface adjacent to the upper end of the bag member, the second point being located at a lower portion of the bag member adjacent to the bottom surface, wherein the second shoulder strap includes a quick-release detachment mechanism adjacent to the second point of attachment, the quick-release detachment mechanism configured to detach the bottom end of the at second shoulder strap from the bag member.

18. The backpack of claim 16, further comprising an article strap positioned on the at least one shoulder strap, the article strap having a length shorter than a length of the shoulder strap, the article strap tensioned sufficiently to hold an article of clothing between the article strap and the at least one shoulder strap.

19. The backpack of claim 16, wherein the front closeable opening of the front compartment includes a flap that, when opened, extends away from the bag member such that an interior of the front compartment is visible.

20. The backpack of claim 19, wherein the interior of the front compartment includes an eyewear pouch sized to contain eyewear.

21. A backpack for skiing equipment, the backpack comprising:

a bag member including a back surface for contacting a user's back, a front surface, two opposes sides, a bottom surface, at least one shoulder strap attached adjacent to the back surface, and an upper end;

a pair of side compartments located at each of the opposed sides, each side compartment having a closure and an approximately triangular side profile defined by the respective opposed side, and substantially perpendicular back and bottom surfaces, the front surface defined by a plane extending along the longest side of the triangle and between the opposed sides;

a central compartment located between the back surface and the front surface and flanked by the side compartments; and the substantially triangle side profile having a flat section defining a top surface, the flat section perpendicular to the back and parallel to the bottom surface, and an angle sloping downward toward the bottom surface to define the front surface, the bottom surface extending farther than the top surface to meet the front surface, the front surface defined by a plane extending the longest side of the triangle defining the triangular side profile and extending between the opposed sides;

a boot void compartment occupying an area between the opposed sides and the front surface on each side of the central compartment and having closures vertically aligned with the closures on respective side compartments, the boot void compartment having a generally triangular profile defined by the front surface and a smaller triangle sharing the longest side with the front surface, the boot void compartment defined by the front surface, a respective side surface and the smaller triangle; and a front compartment, the front compartment disposed between the central compartment, and the plane defining the front surface, and between the boot void compartments.

22. The backpack of claim 21 wherein the front compartment is accessed via a front closable opening on the front surface that permits horizontal access into the front compartment, the front compartment being separated from the central compartment by a divider extending at least partially from the bottom surface to the upper end of the bag member and flanked by the boot void compartments.

23. The backpack of claim 21, wherein each side compartment defines a boot void compartment within the side compartment, the boot void compartment having a generally triangular profile and located adjacent to the front face of the bag member such that when a boot is contained within the side compartment each boot void compartment is positioned between the front surface of the bag member, a shin portion of the boot, and a toe portion of the boot; and wherein the at least one shoulder strap has a top end and a bottom end, the top end is attached to the bag member at a first point and the bottom end at a second point, the first point being located on the back surface adjacent to the upper end of the bag member, the second point being located at a lower portion of the bag member adjacent to the bottom surface, wherein the first shoulder strap includes a quick-release detachment mechanism adjacent to the second point of attachment, the quick-release detachment mechanism configured to detach the bottom end of the at least one shoulder strap from the bag member.

* * * * *